United States Patent [19]

Guertin

[11] Patent Number: 5,034,250

[45] Date of Patent: Jul. 23, 1991

[54] METHOD FOR REDUCING THREADLINE BREAKAGE

[75] Inventor: Earl W. Guertin, Midlothian, Va.

[73] Assignee: E. I. du Pont de Nemours and Company, Wilmington, Del.

[21] Appl. No.: 606,085

[22] Filed: Oct. 30, 1990

[51] Int. Cl.[5] ..... B05D 1/02

[52] U.S. Cl. ..... 427/394; 427/424; 118/325; 242/47.09; 242/157 R

[58] Field of Search ..... 427/424, 394; 118/325; 242/47.09, 157 R

[56] References Cited

U.S. PATENT DOCUMENTS

| | | | |
|---|---|---|---|
| 2,558,731 | 7/1951 | Cresswell | 242/47.09 X |
| 2,746,281 | 5/1956 | Drisch et al. | 242/47.09 |
| 2,885,878 | 5/1959 | Kocay et al. | 118/325 |
| 4,056,240 | 11/1977 | Gallini et al. | 242/47.09 |

*Primary Examiner*—Shrive Beck

[57] ABSTRACT

A process is disclosed for reducing yarn threadline breakage during the washing step of a wet spinning operation to make fine denier yarns.

5 Claims, 1 Drawing Sheet

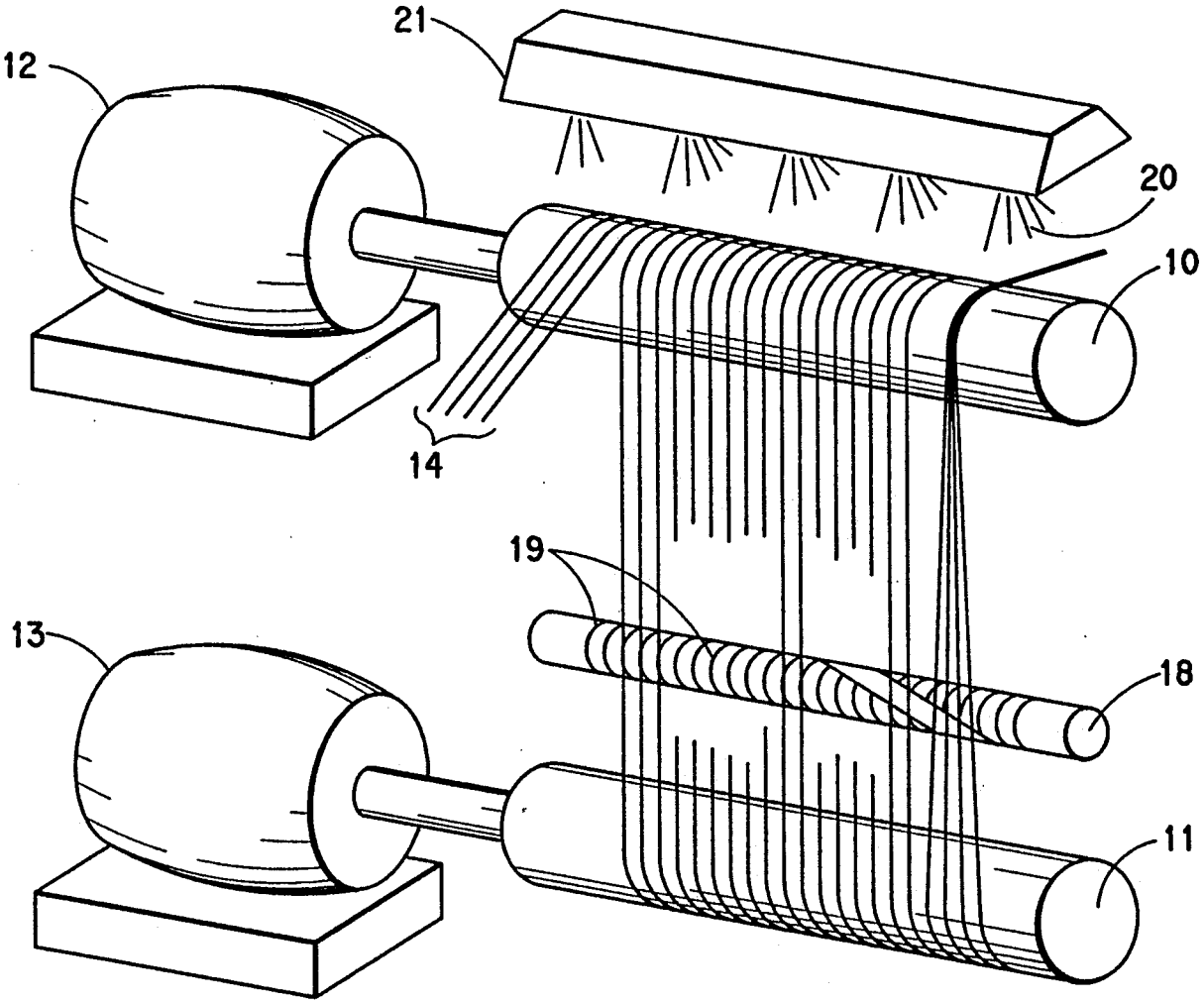
FIGURE

METHOD FOR REDUCING THREADLINE BREAKAGE

BACKGROUND OF THE INVENTION

1. Field of the Invention

The present invention relates to a process for reducing yarn threadline breakage during the washing step of a wet spinning operation to make fine denier yarns.

2. Description of the Prior Art

U.S. Pat. No. 4,056,240, issued Nov. 1, 1977 on the application of Gallini et al., discloses a yarn guide which can be used to separate several wraps of a yarn about a pair of rolls. The yarn guide is said to be useful for yarns of greater than 200 denier and it is recommended that the yarn guide grooves be separated by more than 0.4 centimeter.

SUMMARY OF THE INVENTION

The present invention provides a process for treating a plurality of never-dried yarn threadlines with a liquid bath comprising the steps of separating the never-dried yarns to be treated by a threadline separation means such that they are spaced apart a distance of at least 0.64 cm (0.25 inch) from each other, passing the spaced apart yarns from the threadline separation means to the first of a pair of rolls driven by a speed controlling means such that the rolls in the pair are turning at surface speeds having a difference of less than 0.05%, turning the never-dried yarns around the second of the pair of rolls, treating the yarns by contact with a liquid bath as the yarns pass between the rolls, and removing the yarns from the rolls.

BRIEF DESCRIPTION OF THE DRAWINGS

The FIGURE is a representation of a pair of rolls as can be used in the process of this invention.

DETAILED DESCRIPTION OF THE INVENTION

It has been a common problem in the manufacture of low-denier yarns that the yarns break during liquid processing on roll machines; and the problem has been present, to some extent, for yarns of higher denier, as well. In liquid processing of never-dried yarns, such as in washing or neutralizing yarns immediately after spinning, the yarns are customarily turned several times around pairs of rolls and the yarns are sprayed or otherwise contacted with washing or neutralizing liquids. Process continuity has been very difficult to maintain in the past due to filament breaks leading to yarn breaks and shutdown of the processing machine. It has now been discovered that some imbalance of tensions exists between the rolls, as they have been customarily driven. In the past, it has usually been the practice, in the manufacture of light denier yarns, to drive one of a pair of rolls by means of a synchronous motor and the other of the pair by an induction motor. In manufacture of heavier denier yarns, the second of the pair of rolls was often undriven and operated as an idler. That combination of motors or motor and idler was believed necessary to accommodate variations in roll diameter which would result in different roll surface speeds even if the motors turned at identical speeds. In practice, the speed of induction motors lags slightly behind the speed of synchronous motors; and those different speeds are now believed to have caused excessive tension of the yarns between the rolls.

It has been discovered that the problem of yarn breakage during liquid treatment on rolls can be alleviated by use of synchronous motors to drive both rolls in a pair. Use of such synchronous motors, set to drive the rolls at substantially the same speed, and taken with the use of rolls having substantially the same diameter, has been found to yield fewer yarn breaks than use of the prior art set up. However, mere use of synchronous roll driving motors does not reduce yarn breakage to an acceptable level with all deniers of yarns.

A slight tension must be applied to the threadlines to assure proper advancement and maintenance of proper spacing That tension is preferably as low as possible and is usually from about 0.2 to about 2.0, and preferably about 0.5 to 1.0 gpd. Threadlines are introduced to the pair of rolls under an appropriate tension and the tension is maintained throughout passage of the threadlines over the rolls so long as the surface speeds of each of the rolls in the pair are substantially the same.

Independent of the use of particular roll driving motors, it has been found that the incidence of yarn breakage during liquid treatment can, also, be decreased by spacing yarns on the rolls and between the rolls at distances which substantially eliminate any attraction between adjacent yarns due to surface tensions of the treatment liquid. It has been recognized that adjacent yarns, when closely-spaced, are pulled even closer together by surface tension forces of the treatment liquid when the liquid can form a liquid web between the yarns. In the past, it has been the practice to space yarns of the rolls as closely as possible in order to increase the efficiency of the system. It has now been discovered that, when the yarns are closer than about 0.64 cm (0.25 inch) apart, the treatment liquid draws them even closer together leading to filament breakage and wraps and eventual yarn breakage. While spacing the yarns more than about 0.64 cm (0.25 inch) apart alleviates the yarn breakage problem, it does not, alone, reduce yarn breakage to an acceptable level with all deniers of yarns.

This invention relates to the combination of the use of feed rolls having closely-controlled speeds and yarn spacing on those rolls of greater than about 0.64 cm (0.25 inch). Roll speeds and yarn spacing seems to be independent matters, each outside of the influence of the other. Either of the elements of the combination provides a modicum of improvement; but both elements used together provide an unexpectedly large improvement. Because the elements seem independent, there is no reason to expect that the improvement realized by each would be more than cumulative. However, it has been discovered that, when both elements are used together, yarn breaks are substantially eliminated for liquid treatment of yarns over feed rolls.

Referring to the drawing, which is a representation of a liquid treating device for practicing the process of this invention, rolls 10 and 11 are driven by synchronous motors 12 and 13. Never-dried yarns 14 are introduced in multiple ends—four are shown in the FIGURE—to the rolls, are repeatedly turned around the rolls, and are spaced apart by means of guide roll 18 having appropriately-spaced grooves 19. Liquid 20 for treatment of the never-dried yarns is delivered to the system such as by being sprayed from liquid manifold bar 20 to contact the yarns.

In operation, individual threadlines of yarn 14 to be treated with liquid 20 are separated by a threadline separation means, such as by the grooves 19 in guide roll 18, and the individual threadlines are, then, passed from the threadline separation means to the first of a pair of rolls 10 driven by a speed controlling means such as synchronous motor 12. From roll 10, the yarn is turned around the second of the pair of rolls 11 which is driven by a speed controlling means such as synchronous motor 13. The yarn can be repeatedly turned around the pair of rolls and the yarns are treated by being contacted with a liquid 20 from manifold 21. The rolls and manifold are customarily enclosed in an appropriate housing (not shown). The yarn is, finally, removed from the rolls for drying or further treatment of any kind or type desired (not shown). An appropriate guide roll 18 is disclosed in U.S. Pat. No. 4,056,240.

It is important to the practice of this invention that the grooves must be spaced at least 0.64 cm (0.25 inch) apart in order to provide a separation for the individual threadlines of at least 0.64 cm (0.25 inch). It is also important to the practice of this invention that rolls 10 and 11 be rotated at surface speeds having a difference of less than 0.05%, and preferably less than 0.01%. One preferred means for achieving the roll surface speed requirement is to use synchronous motors to drive both rolls.

The process of this invention finds most use in the liquid treatment of yarns having a low denier; but the processing of all yarns can benefit. Low denier yarns, such as yarns of 50 or as high as 400 denier, are most benefited by the process of this invention because low denier yarns are most affected by the surface tension forces of a liquid treatment and low denier yarns are more likely to be damaged by inequalities in roll surface speeds which result in surges in tension on the yarns.

Liquid treatment of yarns can be conducted at practically any threadline speed ranging from as low as 200 to as high as 2000 meters per minute with threadline breaks occurring at all speeds. Practice of the process of this invention will permit substantially break-free operation at all speeds for substantially all yarns above about 25 denier.

The process of this invention is particularly useful in washing, neutralizing, or other liquid treatment of wet or air gap spun fibers directly after the coagulation bath. Such wet or air gap spun fibers include fibers of meta-aramids such as poly(m-phenylene isophthalamide), para-aramids such as poly(p-phenylene terephthalamide), and the like.

DESCRIPTION OF THE PREFERRED EMBODIMENTS

EXAMPLE A

I. This example demonstrates a conventional roll machine used for washing and neutralizing never-dried fibers after spinning. In this conventional set-up, there were two pairs of rolls. Each pair was equipped with an induction motor to drive one roll and a synchronous motor to drive the other; and each pair had close spacing for the adjacent yarn turns. Two hundred denier para-aramid yarn directly from the coagulation bath was turned over the rolls of each pair. Although the rolls were determined to be the same size and the motors were set to turn the rolls at the same speeds, the speed of the induction motors tended to lag as much as 0.5% slower than that of the synchronous motors. Moreover, adjustment of the speed of the motors was unsatisfactory because, even careful adjustment resulted in severe tension variations which produced threadline breaks. Adjacent threadlines were separated by 0.48 cm (0.19 inch), as in conventional operation. In typical operation of this set-up using 12 yarns around each roll, for liquid treatment of the yarns at about 550 meters/min, the device was never run more than 12 hours without a break, breaks usually occurred every 2 to 3 hours, and breaks often occurred instantaneous with attempted start-up.

II. This example demonstrates the roll machine set-up of Example A. I., above, but using synchronous motors to drive the rolls. Adjacent threadlines were close-spaced at 0.19 inch. Two hundred denier para-aramid yarn directly from the coagulation bath was turned over the rolls of each pair. The synchronous motors were capable of turning the rolls at surface speeds with less than 0.05% difference and the surface speeds were adjusted to maintain a threadline tension between the rolls of about 1.0 gpd. Operation of the machine at a speed of about 500 meters/min; along with contact by aqueous washing and neutralizing treatment solutions, resulted in poor continuity of operation with frequent filament wraps and yarn breaks in spite of the synchronous motors and the sameness of roll surface speeds. Adjacent yarns were attracted to each other by the surface tension of the treatment solutions and, as a result, individual filaments from adjacent yarns became entangled and broke, causing more filaments to break, resulting, finally in a yarn break. In five test runs, run times ranged from 30 minutes to 12 hours, averaging about 5 hours before breaks occurred. The breaks in this case were fewer than in the previous case using a conventional motor set-up and closely spaced yarns; but the breaks were, nevertheless, excessive and unacceptable.

III. This example demonstrates the roll machine set-up of Example A. I., above, but using only 6 yarns around each roll and a yarn spacing of 0.96 cm 0.38 inch). Two hundred denier para-aramid yarn directly from the coagulation bath was turned over the rolls of each pair. Operation of this set-up yielded the same performance results as were obtained in Example A. I., above.

It can be understood from these preliminary examples that the use of induction and synchronous motors for fine-denier yarn treatments yields unacceptable results and, when synchronous motors are used in pairs, there is improvement but performance is still unsatisfactory when conventional threadline spacing is used.

EXAMPLE 1

Two hundred denier para-aramid yarn directly from the coagulation bath was turned over the rolls of a roll machine in which there were two pairs of rolls which were fitted with synchronous motors capable cf turning the rolls at surface speeds having less than 0.05% difference between the pairs. The yarns were spaced apart 0.96 cm (0.38 inch); and there were six yarns on each pair of rolls. As was the case in the three comparison runs of Example A, above, the yarns were passed from a pre-feed roll guide to and around the first of the pair of rolls, and then to and around the second of the pair of rolls. In operation of this Example, the desired roll speeds were established and all speeds were adjusted to be the same. The yarn was fed to the machine and the yarn tension was adjusted to be about 1 gram per denier. The yarns were treated, on the first pair of rolls, by water to wash coagulation bath acid from the fibers; and, on the second pair of rolls, by a dilute caustic solution to neutralize any residual traces of the acid. The machine was operated at a speed of about 550 meters/-min for 36 hours without a break in yarn.

EXAMPLE 2

Using the machine of Example 1, with synchronous motors, 400 denier aramid yarn was treated by water and dilute caustic as was described in Example 1; and there were 12 yarns on each pair of rolls. The yarn spacing was reduced to 0.66 cm (0.26 inch) and the yarn tension was set at 0.7 to 1.0 grams per denier. At a roll speed of about 550 meters per minute, there was only one break in 6 days of continuous operation; and that one break was due to an operator handling error.

In a control run of the roll machine of Example A. I., above, using the 400 denier aramid yarn of this Example 2 and a yarn spacing of 0.19 inch, it was determined that operation using the heavier yarn is better than with 200 denier yarn; but that the performance is, nevertheless, unacceptable. In five test runs, run times ranged from 4 to 32 hours, averaging about 15 hours before breaks occurred. Yarn breaks occurred regularly and the longest break-free periods were from 18 to 36 hours.

EXAMPLE 3

The procedure of Example 2 was repeated using 200 denier aramid yarn. At a roll speed of about 550 meters per minute, a yarn tension of 0.7 to 1.0 gram per denier, and yarn spacing of 0.66 cm (0.26 inch), there were no yarn breaks in 72 hours of operation—the duration of that test run.

I claim:

1. A process for treating a plurality of never-dried yarn threadlines with a liquid bath comprising the steps of:

a) separating the never-dried yarns to be treated by a threadline separation means such that they are spaced apart a distance of at least 0.64 cm from each other;

b) passing the spaced apart yarns from the threadline separation means to the first of a pair of rolls driven by a speed controlling means such that the rolls in the pair are turning at surface speeds having a difference of less than 0.05%;

c) turning the never-dried yarns around the second of the pair of rolls;

d) treating the yarns by contact with a liquid bath as the yarns pass between the rolls; and e) removing the yarns from the rolls.

2. The process of claim 1 wherein the rolls in the pair are turning at surface speeds having a difference of less than 0.01%.

3. The process of claim 1 wherein the rolls are driven by synchronous motors.

4. The process of claim 1 wherein the yarns are up to 400 denier.

5. The process of claim 4 wherein the yarns are poly(p-phenylene terephthalamide) yarns.

* * * * *